US008810465B2

(12) United States Patent
Knadle et al.

(10) Patent No.: US 8,810,465 B2
(45) Date of Patent: Aug. 19, 2014

(54) DISTRIBUTED COMB TAPPED MULTIBAND ANTENNA

(75) Inventors: Richard T. Knadle, Dix Hills, NY (US); Mark W. Duron, East Patchogue, NY (US); Rehan K. Jaffri, New York, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 380 days.

(21) Appl. No.: 13/297,976

(22) Filed: Nov. 16, 2011

(65) Prior Publication Data

US 2013/0120194 A1 May 16, 2013

(51) Int. Cl.

| | |
|---|---|
| ***H01Q 9/16*** | (2006.01) |
| ***H01Q 5/00*** | (2006.01) |
| ***H01Q 19/30*** | (2006.01) |
| ***H01Q 9/40*** | (2006.01) |
| ***H01Q 21/06*** | (2006.01) |
| ***H01Q 9/28*** | (2006.01) |

(52) U.S. Cl.

CPC ..... *H01Q 5/0051* (2013.01); *H01Q 19/30* (2013.01); *H01Q 9/40* (2013.01); *H01Q 21/062* (2013.01); *H01Q 9/285* (2013.01)

USPC ..... 343/793; 343/700 MS; 343/846; 343/745

(58) Field of Classification Search

USPC ..... 343/700 MS, 702, 793, 846, 745

See application file for complete search history.

(56) References Cited

U.S. PATENT DOCUMENTS

| | | | | |
|---|---|---|---|---|
| 5,926,150 | A | 7/1999 | McLean et al. | |
| 2009/0128428 | A1* | 5/2009 | Ishizuka et al. | 343/702 |
| 2009/0295652 | A1* | 12/2009 | Yagi et al. | 343/702 |

* cited by examiner

*Primary Examiner* — Dieu H Duong
(74) *Attorney, Agent, or Firm* — Brian M. Mancini

(57) ABSTRACT

A distributed comb tapped multiband antenna structure includes a PIFA-like antenna radiator having tap structures, and a counterpoise to the antenna radiator, wherein the tap structures include shunt connections to the counterpoise. A second antenna radiator is collinear and opposing the antenna radiator while sharing the counterpoise in common with the antenna radiator, such that the antenna structure is configured as a balanced dipole. The antenna structure can be contained internally within a single device housing and can operate over multiple frequency bands. The antenna provides high performance over a considerable bandwidth within each of the multiple frequency bands of operation, even where the frequency bands are not harmonically related.

17 Claims, 11 Drawing Sheets

500

500

DISTRIBUTED COMB TAPPED MULTIBAND ANTENNA

FIELD OF THE DISCLOSURE

The present invention relates generally to antennas and more particularly to multiband antenna structures.

BACKGROUND

The size of wireless communication devices is being driven by the marketplace towards smaller and smaller sizes. Consumer and user demand has continued to push a dramatic reduction in the size and weight of communication devices. To accommodate this trend, there is a drive to combine components and functions within the device, wherever possible, in order to reduce the volume of the circuitry. However, internal antenna systems still need to properly operate over multiple frequency bands and with various existing operating modes. For example, network operators providing service on the fourth generation Long Term Evolution (4G LTE) are also providing service on 3G systems, and the device must accommodate both these systems and their operating frequency bands.

The obvious solution is to provide separate antennas for each operating frequency band. However, this requires more room in the device, and conflicts with the technical requirements for enhanced operability of communication devices along with the drive for smaller device sizes.

What is needed is a communication device with an antenna structure that is contained internally within a single device housing, and that operates over multiple frequency bands, where the antenna structure is connected to a transceiver of the communication device by a single transmission line. The antenna must have high performance over a considerable bandwidth within each of the multiple frequency bands of operation, even where the frequency bands are not be harmonically related.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
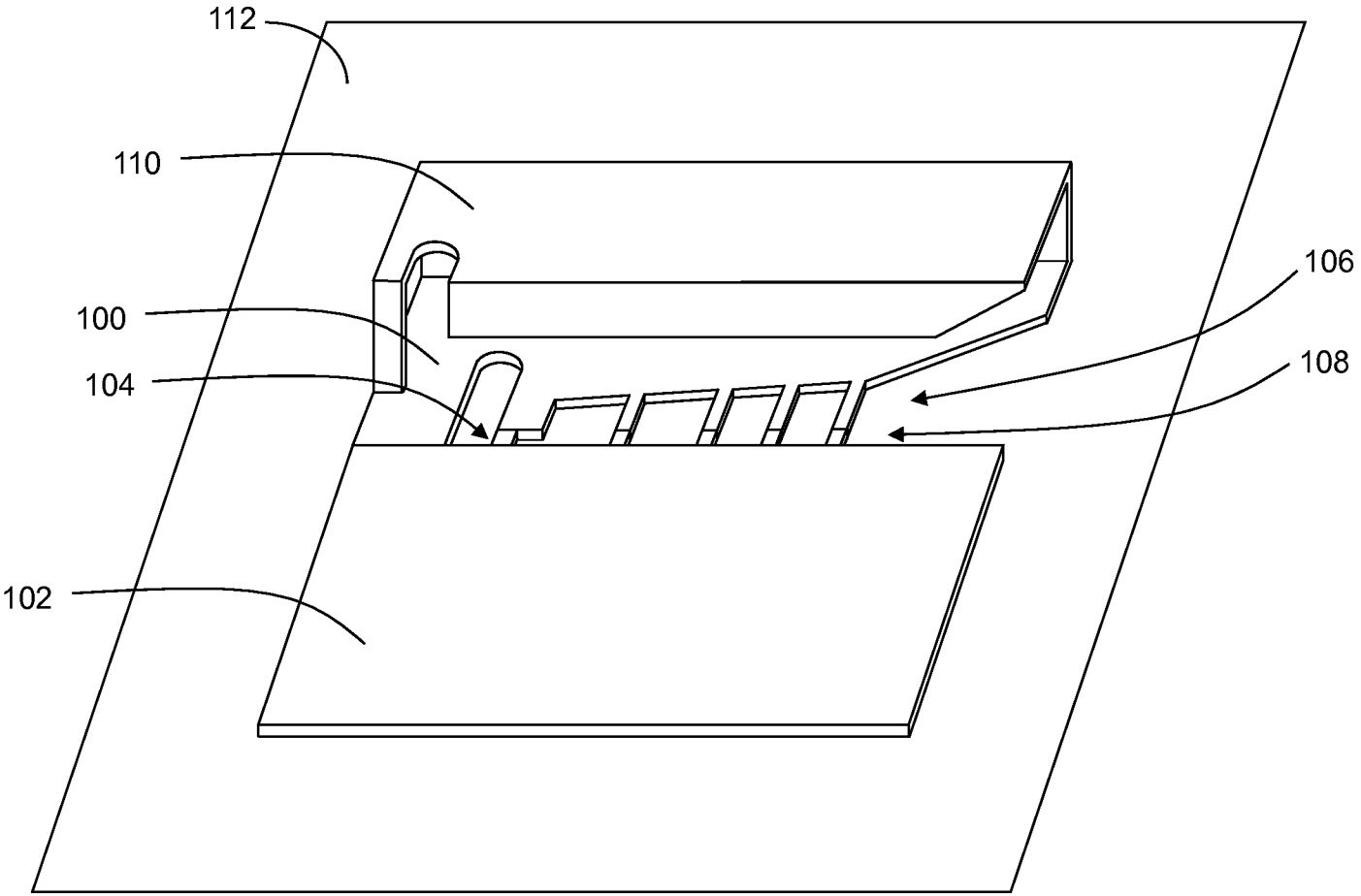
FIG. 1 is a perspective view of an antenna structure with components disposed thereon, in accordance with the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

The present invention provides an antenna structure that is contained internally within a single housing of a communication device. The antenna structure is operable over multiple frequency bands, and can be driven at a single feed point by a single transmission line, or it can be driven at multiple feed points by multiple feed lines. The antenna structure provides high performance over a considerable bandwidth within each of multiple frequency bands of operation, even where the frequency bands are not be harmonically related.

The antenna design of the invention is particularly applicable to hand held wireless communication products, such as a cell phone for example, where the available volume within the housing of the device is very limited, and the antenna must provide high performance across multiple bands despite the detriment of a client's hand essentially covering, and being almost wrapped around, the antenna. Preferably, within a compact wireless communication product, the present invention will provide the antenna designer with a large number of selectable LCR equivalent components that have a Lattice Equivalent Circuit (for instance), which will allow the designer to adapt the antenna design to the many diverse size and frequency constraints of the various environments within which different devices will operate.

FIG. 1 is a perspective view of a monopole type antenna structure with a plurality of comb line shunt connections, in accordance with the present invention. Such an antenna structure can be used in various wireless communication devices. In particular, this figure represents a four-tap, distributed comb-tapped multiband antenna structure. Although a quasi-planar inverted F-antenna (PIFA-like) radiator 100 is shown mounted on an insulating substrate 112 (e.g. Kapton™ tape) in this example, it should be recognized that the present invention is applicable to any other antenna type and mounting. The antenna structure is driven at a feed point 104. The feed point can be connected by a single transmission line (such as from below through the substrate 112 in this example) to particular transceiver circuitry of the communication device (not shown). A conductive plate 102 of the antenna structure serves as a counterpoise to the PIFA-like radiator 100. The PIFA-like radiator 100 includes a plurality of comb line shunt tap structures 106 that have connection points to the plate 102. The configuration and location of the feed point 104 and tap structures 106 are tuned for the operating frequency bands of the communication device.

Preferably, the connection points are reactive elements 108 disposed at the end of at least one of each of the comb line tap points, so that the reactive elements can be used for fine tuning the antenna structure. Each reactive element 108 can include LCR components that can be statically or dynamically configured, either upon manufacture of the antenna structure or during its use. In one embodiment, the reactive elements are simply capacitances. Each tap structure presents a composite LCR shunt reactance between the chosen position along the PIFA-like radiator, and the antenna counterpoise. The position and spacing of each tap structure is chosen so as to determine a particular inter-tap series inductive reactance that will exist along the PIFA-like radiator between the particular adjacent tap structures. In particular, the local cross sectional height and width in the vicinity of each particular tap structure will determination the series inter-tap reactance (which is primarily an inductance) that will exist between a particular pair of tap structures. In addition, the tap reactance and/or a local electronic equivalent spacing of the tap structures can be affected by creating a mechanical modification within the counterpoise structure, such as an indentation, undulation, or defection in the counterpoise structure.

In the embodiment shown in FIG. 1, the PIFA-like radiator 100 can include a folded portion 110 for an even further compact profile without sacrificing performance. The folded portion 110 can be wrapped around an insulating block (not shown for drawing clarity). In the shown configuration, the antenna structure of the present invention is operable on four different (non-harmonic) frequency bands where two of the bands have a bandwidth over more than 23%.

The comb line shunt taps of the PIFA-like radiator can provide periodic or non-periodic elements that each resemble a strip line structure. In one embodiment, each tap structure presents a particular shunt reactance at a particular location along the PIFA-like structure. Each shunt reactance magnitude depends on the shape and length of the tap structure, and on the LCR lumped reactance component that is located within the tap. The net result of this comb configuration is a slightly volumetric antenna that has an LCR lattice equivalent circuit that has a plurality of resonating and radiating frequencies. Each of the designed resonating frequencies can be tuned to simultaneously present a desirable impedance to the transmission line, as well as presenting a desirable radiation impedance. Each of the resonating and radiating frequencies can be quite broad band, and they are not required to be harmonically related. In a further embodiment, variable reactive tuning elements (which can be electronically tunable) terminate each tap structures in order to dynamically change the limits of an operating frequency band, achieve greater selectable bandwidth within a frequency band, or to change the performance between the frequency bands of operation.

Figure 2:
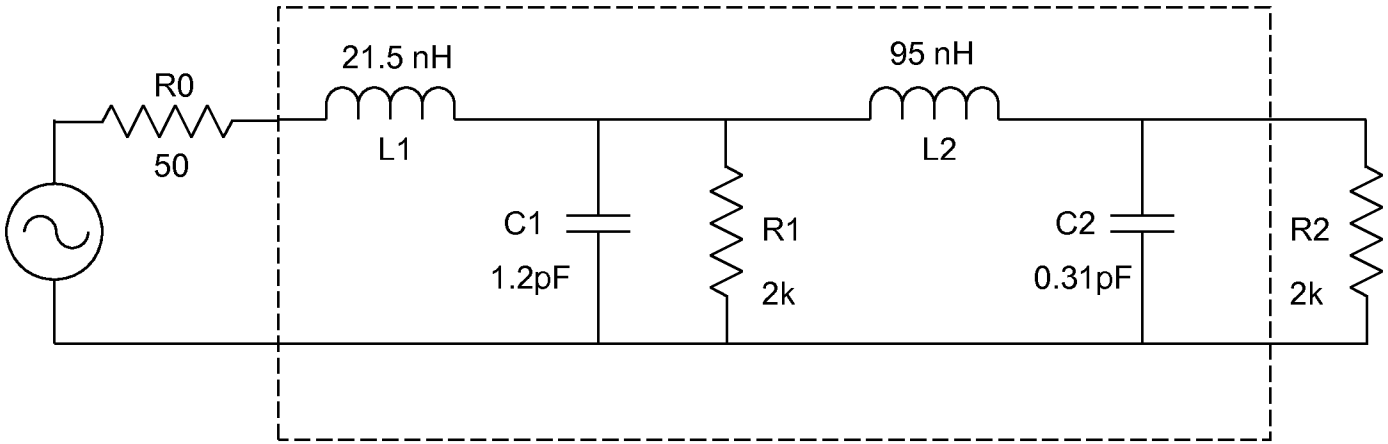
FIG. 2 is a circuit diagram of an equivalent ladder circuit for two taps of the antenna structure of FIG. 1.

FIG. 2 shows a lattice equivalent circuit of an antenna structure having two taps, in accordance with the present invention. L1, C1 and R1 represent the first tap resonator and the first radiation resistance. L2, C2 and R2 represent the second tap resonator and the second radiation resistance. L1 includes the equivalent inductance of the first tap, as well as a portion of the PIFA-like radiator. L2 includes the equivalent inductance of the second tap, as well as a portion of the PIFA-like radiator. L2, C2 and R2 receive coupled and radiated energy from the L1, C1 and R1 components. Accordingly, it should be recognized that changing the component values on one tap can affect the component values on other taps. As should also be recognized, the lattice equivalent circuit can be expanded for more taps, such as the four tap embodiment of FIG. 1.

Figure 3:
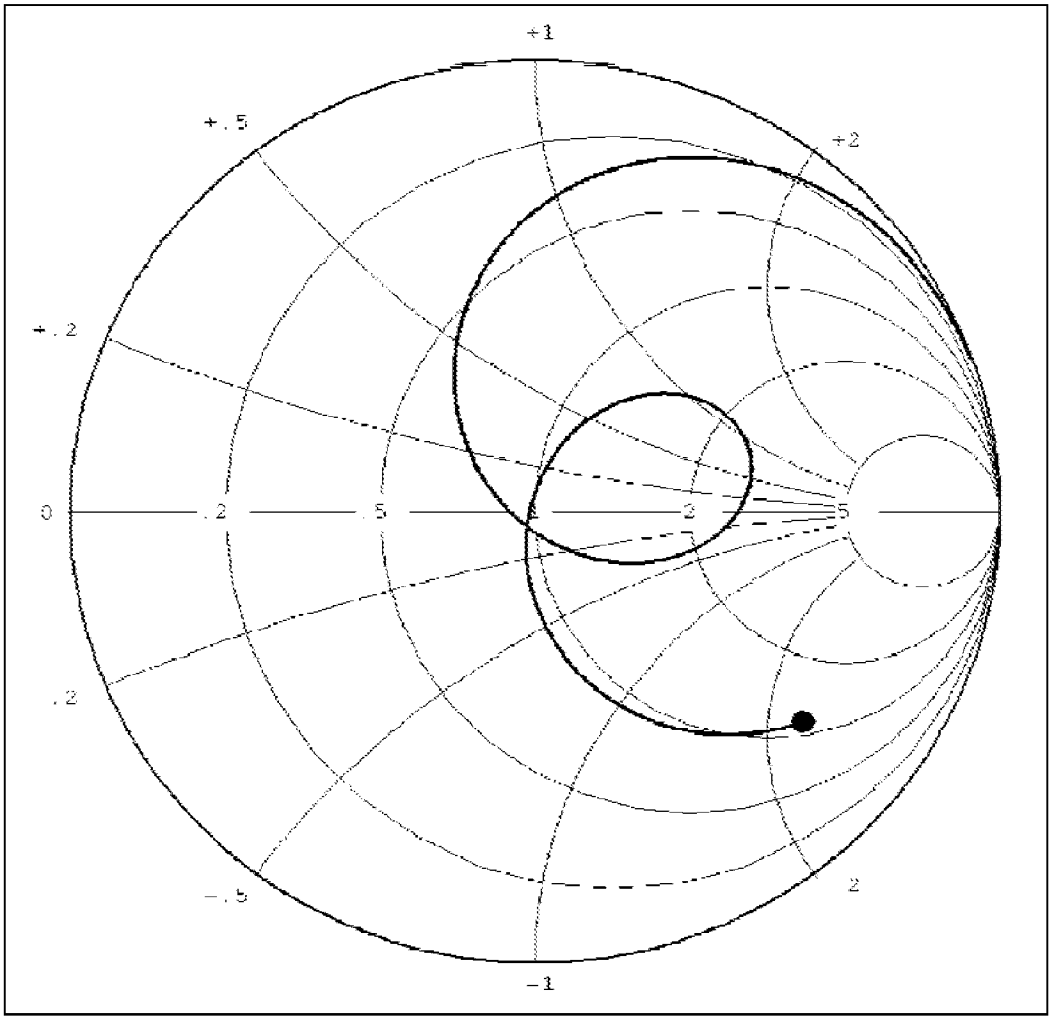
FIG. 3 is a Smith chart graph of the performance of the circuit of FIG. 2.

Simulations have been conducted using the circuit of FIG. 2 as described above. FIG. 3 shows a Smith chart of the simulations of the example antenna of FIG. 2 with two taps, being swept in frequency from 0.5 to 2 GHz. As can be seen there are two frequencies near the center of the chart at about 760 MHz and 1.18 GHz that present a desirable VSWR (or S11) that is nearly 50 ohms, with a reflection coefficient of approximately −30 dB.

Figure 4:
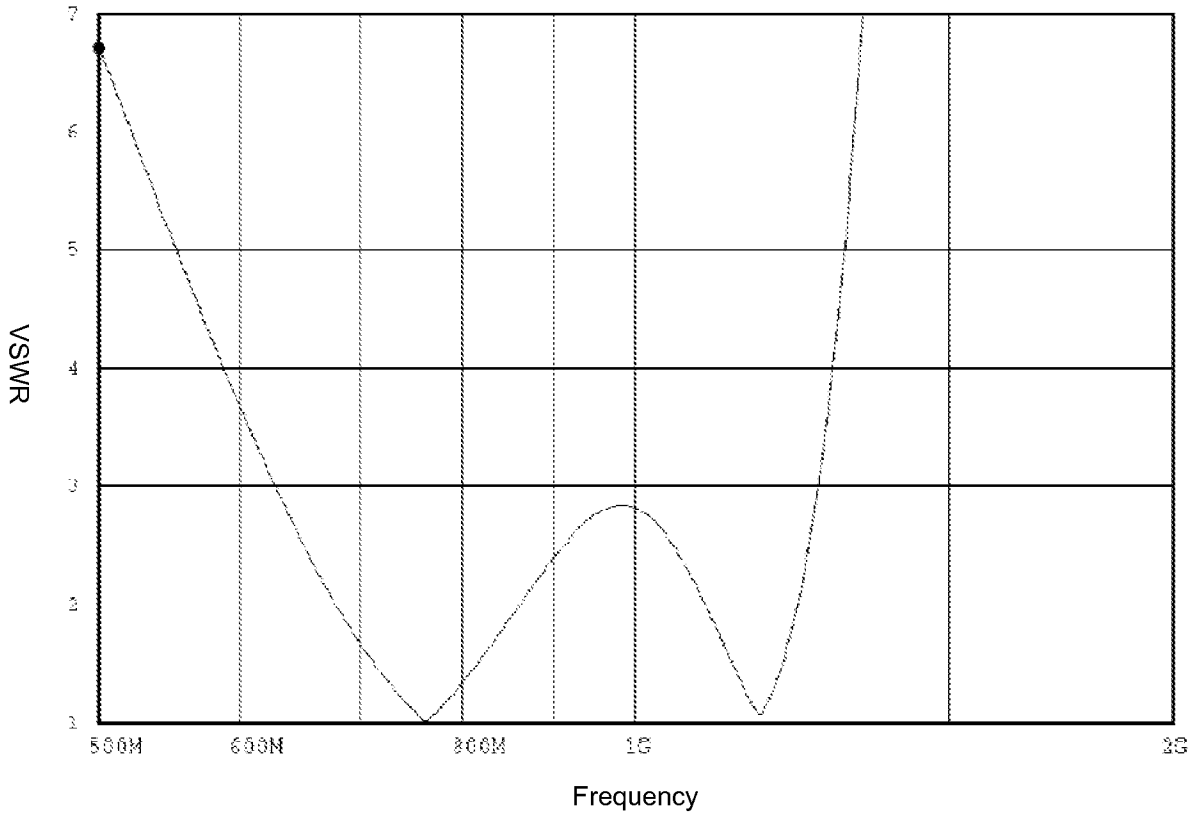
FIG. 4 is a graph of the frequency performance of the circuit of FIG. 2.

FIG. 4 shows a VSWR chart of the same simulation of the circuit of FIG. 2. The antenna displays a VSWR of under 3:1 from 629 MHz to 1,265 MHz. This is a desirable 3:1 VSWR Bandwidth of 65%.

Within a compact wireless communication device, the present invention will provide the antenna designer with a large number of selectable LCR equivalent antenna components that have a lattice equivalent circuit (for instance), which will allow the adaptation of the antenna design to many more of the size and frequency constraints of the environment within which it must operate.

Many of the selectable LCR lattice equivalent components, and their combinations of resonant frequencies and radiation resistances, consist of the selected combinations of: the composite shunt-like reactance, that is created within each tap structure, the series-like reactance, that are caused by each of the spaces between the tap structures, as well as the conductor heights, and widths, along the PIFA-like structure between the tap structures, and the conducted couplings, and the radiated couplings between each tap reactance.

The location of each of the tap structures; the width of the PIFA-like radiator in the vicinity of each tap structure; the height of the PIFA-like radiator in the vicinity of each tap structure; and the spacing between particular tap structures, are all simultaneously chosen so that the particular combination of these variables will create an equivalent circuit of the total antenna structure that can be represented with the lattice equivalent circuit (for instance), where by using a process of computer modeling (for instance) of the lattice equivalent circuit, a prediction can be made of the plurality of the resonant frequencies, and of the impedances that will be presented to the driving transmission line—all for the purpose of optimizing the antenna performance over each of the frequency bands of operation.

The width, shape, and length of each of the tap structures, as well as the value of the LCR lumped-components that can be placed within or terminating the tap structure, are used as variables to determine a total LCR equivalent shunt reactance that the tap structure presents at the particular location along the PIFA-like radiator. In addition, the local physical spacing (or electronic equivalent spacing) between the PIFA-like radiator and the counterpoise can be locally varied by creating indentations, undulations, or defections of the counterpoise in the vicinity of each tap structure, for the purpose varying the available physical length (or electronic length) of a particular tap structure, all for the purpose of varying the total LCR shunt reactance that the particular tap structure presents to the PIFA-like radiator at that location. Optionally, variable tuning elements (which could be electronically tunable) are placed within or terminating one or more of the tap structures in order to statically or dynamically change the limits of an operational frequency band, to achieve greater selectable bandwidth within a frequency band, or to change the performance between the frequency bands of operation. In practice, a fixed or variable reactive tuning element can be placed within each tap structure, where some are located more remotely (e.g. at the end of a transmission line that is connected to some of the tap structures), in order to statically or dynamically adjust the frequency limits of a frequency band, or to achieve greater selectable bandwidth within a frequency band, or to change the performance between the frequency bands of operation.

How to determining the large number of LCR lattice equivalent components, and the combinations of their multiple resonances, is not immediately obvious from the physical appearance of the antenna structure. However, the synthesis of the antenna structure of the present invention, that fulfills the desired frequency ranges where the input impedances and radiation impedances are controlled, can be achieved, even though the total number of variables to be selected is large. This is because the process of selecting the equivalent components (and the physical layout) can be aided by the presence of modern antenna modeling programs that can accommodate three dimensional structures. There also are various optimizing and searching procedures, including Monte Carlo and Genetic Programming, that can be used to augment the process of selecting the ideal component values. Modeling of the antenna structure of the present invention can also benefit by the use of a modern vector network analyzer that can simultaneously display the antenna S11 (VSWR), and S21 (Gain), in real time, as the large number antenna components are physically varied. This process will allow the designer to witness the interaction between the large number of variables, within a short period of time.

One optimum approach to configure the antenna structure of the present invention is a three step process: 1) use computer lumped-circuit modeling of a lattice structure: cascade a number of resonators (each being a single L, C, R) that is approximately equal to the number bands required; and adjust the circuit values until desirable S11 responses are achieved, 2) use 3D computer modeling of the antenna structure with the number of tap structures approximately equal to the number of bands to be covered; vary the tap structure parameters until either the same lattice components are derived, or the desirable frequency responses are achieved, and 3) the "slower" 3D model is used to find the approximate component values and their physical layout, to be followed by the "faster" empirical "proof-of-concept" approach where the final values are derived by a physical dithering process while using a VNA on a makeshift antenna range. Only as a last step, is a full performance antenna range required, when quantitative and traceable data must be produced.

In one embodiment, the antenna structure of the present invention can be modified to add at least one further driving transmission line attached in the vicinity of each of one or more of the tap structures, for the purpose of: injecting or receiving a signal, statically or dynamically change the limits of a frequency band, achieve greater selectable bandwidth within a frequency band, or to change the performance between the frequency bands of operation. Each of these transmission lines can be designed to simultaneously achieve and convey a different frequency response to that transmission line, while all are connected to the same antenna radiator.

Figure 5:
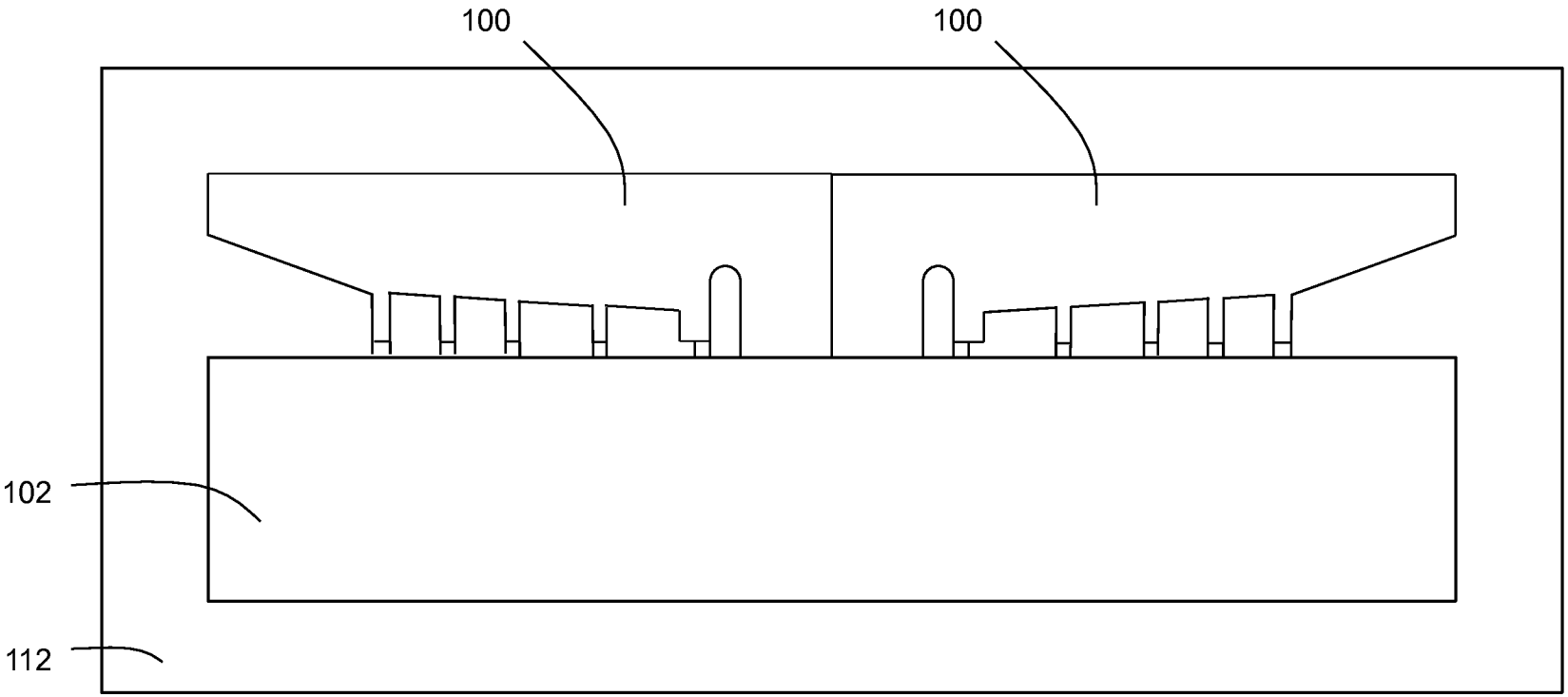
FIG. 5 is a top view of a dipole embodiment of the present invention.

In another embodiment, the antenna structure of the present invention can be modified to add a second radiator to form a pair of collinear and opposing antenna structure, each containing tap structures operating between each of the PIFA-like radiators and a common counterpoise as shown in FIG. 5. This configuration can define a balanced dipole-like antenna structure that operates over a considerable bandwidth within each of multiple bands, which need not be harmonically related.

Figure 6:
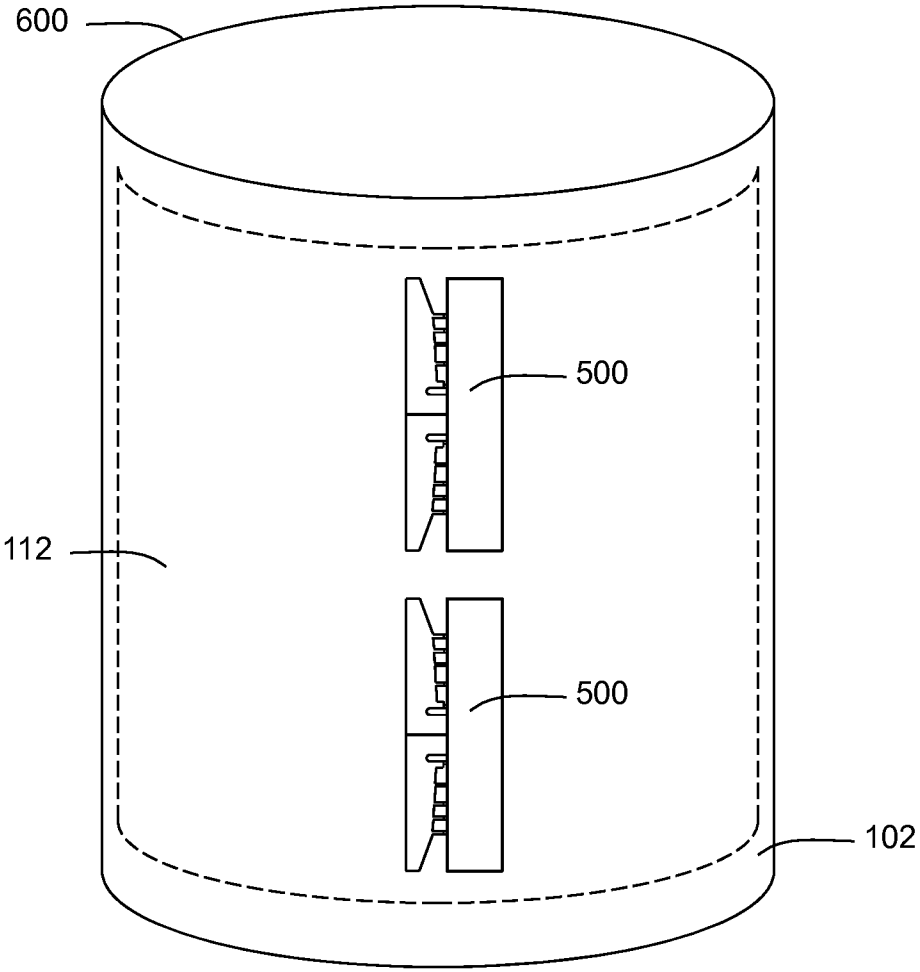
FIG. 6 is a perspective view of a collinear omnidirectional arrangement of FIG. 5.

In one option of this embodiment, one or more of the balanced dipole-like antenna structure of FIG. 5 can be fed in a nearly co-phase manner, for instance, while sharing a common and curved metallic counterpoise that matches the curvature of a transmission tower leg 600, for example as shown in FIG. 6, and the antenna arrangement is applied along the vertical leg of a radio tower in order to achieve a quasi-omnidirectional radiating pattern (with collinear gain) while using the tower leg as the complete antenna counterpoise. This combination will supply a mechanically robust vertically polarized antenna that operates over a considerable bandwidth within multiple bands that may not be harmonically related. This antenna concept could simultaneously supply a communication capability to multiple two-way radio services, for example.

Figure 7:
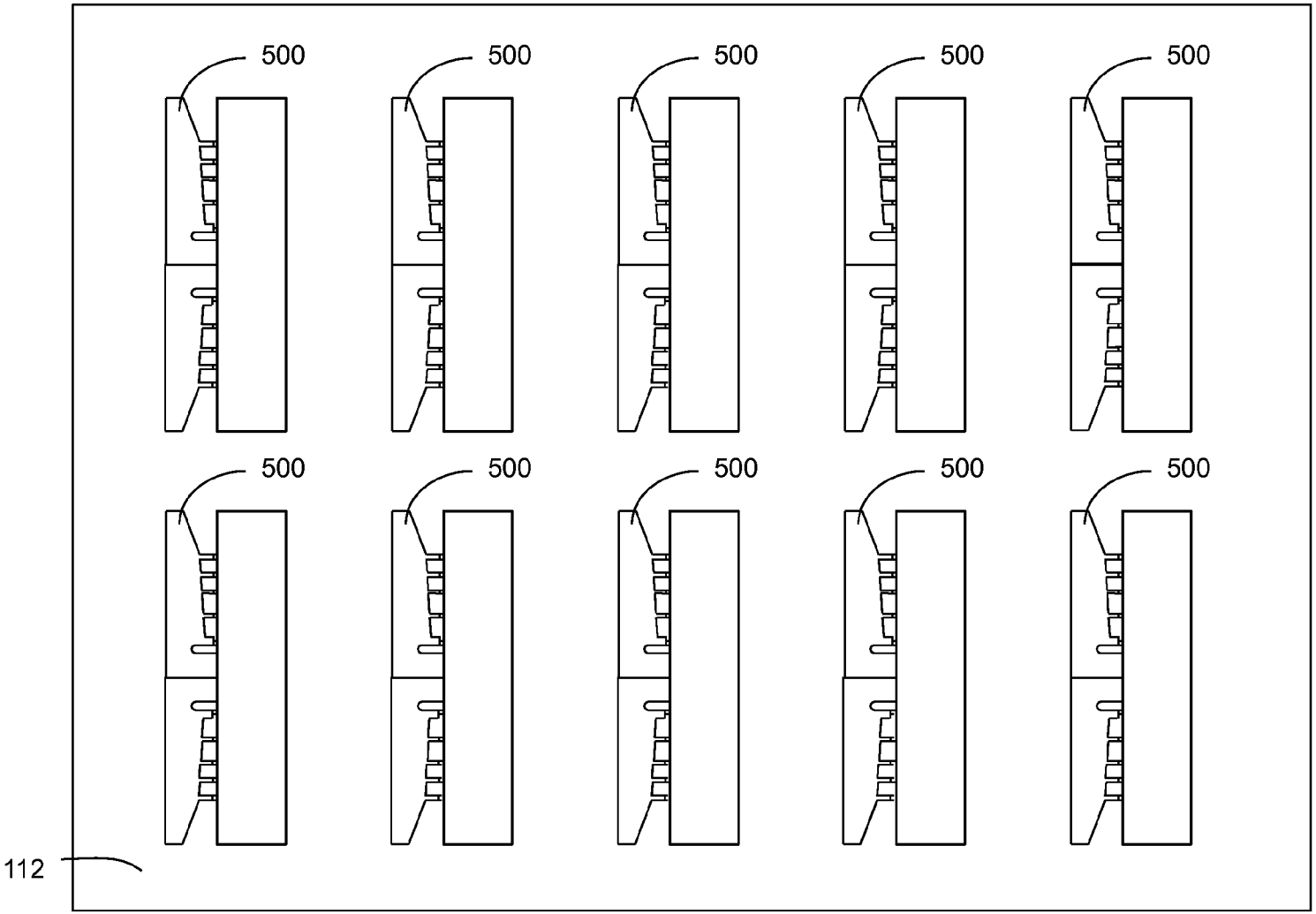
FIG. 7 is a top view of a phased array embodiment of the present invention.

In yet another embodiment, the balanced dipole-like antenna structure of FIG. 5 can be replicated for use within a phased array antenna arrangement, as shown in FIG. 7. Although a 2×5 array is shown it should be recognized that any array dimensions could be used. The phased array can have increased directivity in a chosen direction or directions, as well as being used as the elements of an electronically steerable phased array antenna having performance within multiple non-harmonic bands. In this embodiment, the counterpoise could be present for each dipole (as shown) or could be a sheet conductor that constitutes the back plane (or ground plane) of the phased array antenna arrangement.

Figure 8:
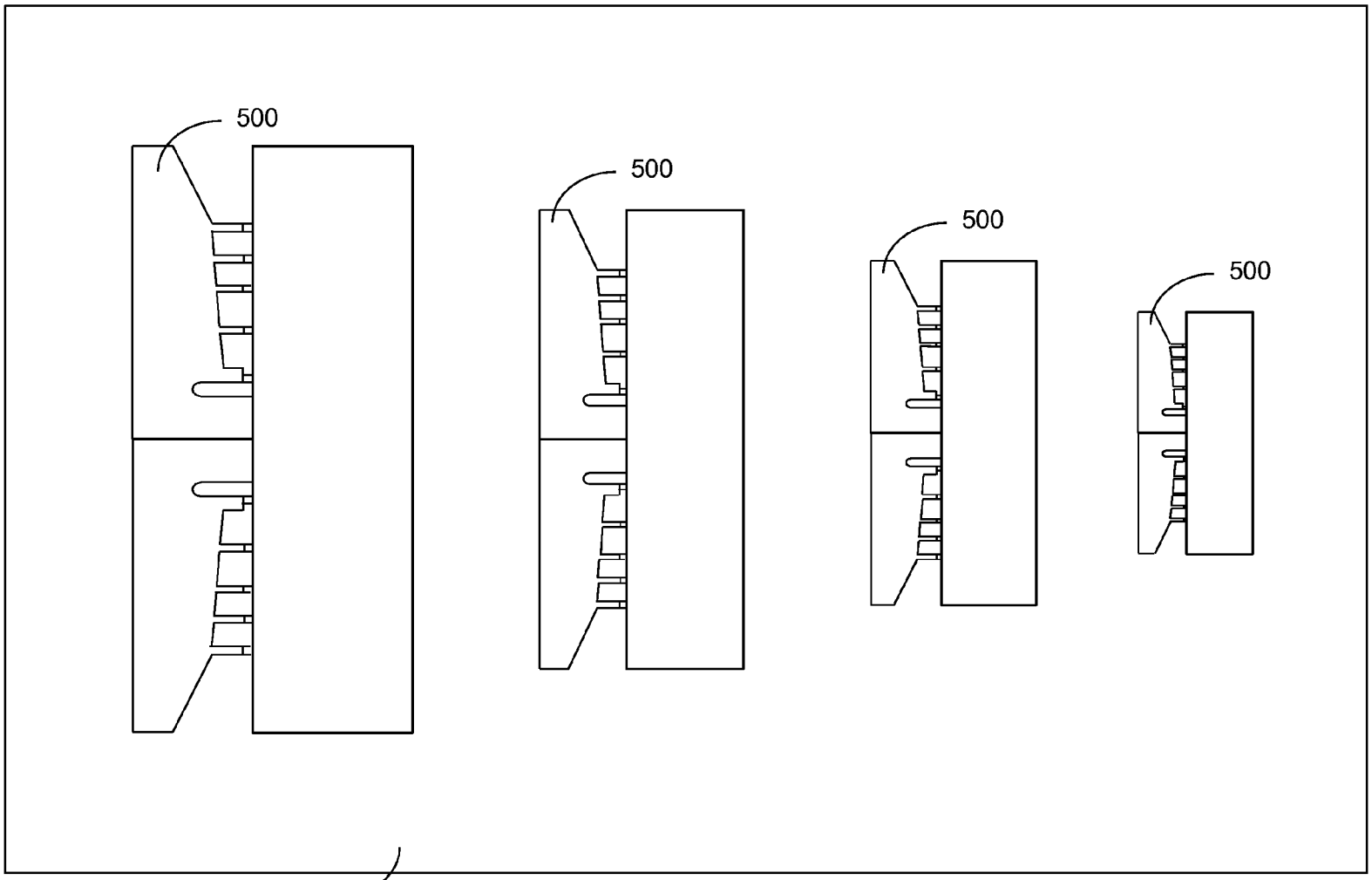
FIG. 8 is a top view of a Yagi-like embodiment of the present invention.

In yet another embodiment, the balanced dipole-like antenna structure of FIG. 5 can be replicated for use within a Yagi-like antenna arrangement, as shown in FIG. 8, or a Log Periodic-like antenna arrangement, to achieve end-fire directivity over a considerable bandwidth, and within multiple frequency bands that need not be harmonically related. Additionally, some of the balanced dipole-like Yagi-like elements or the Log Periodic-like elements can be driven, while some could be parasitic. Of course it should be recognized that any number of elements could be used.

Figure 9:
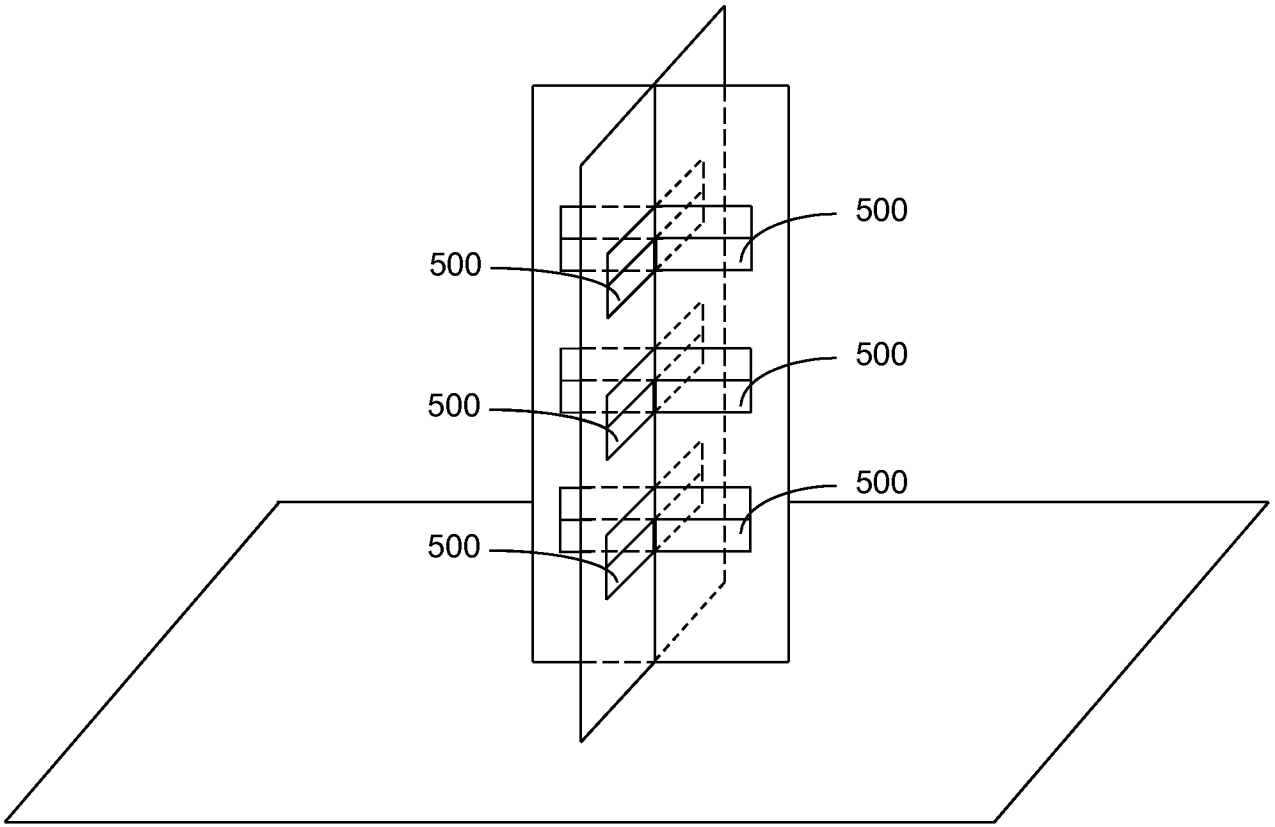
FIG. 9 is a perspective view of an orthogonal Yagi-like embodiment of the present invention.

In yet another embodiment, the balanced dipole-like antenna structure of FIG. 5 can be replicated for use within a Yagi-like antenna arrangement, as shown in FIG. 9, where multiple balanced dipole-like antennas are used within a Yagi-like arrangement containing orthogonal elements in both the horizontal and vertical polarization planes (for instance) so as to create a selectable polarimetry antenna with significant directivity and significant bandwidth within one or more bands that need not be harmonically related. Many bore sight beam polarization states (linear, elliptical or circular) can be selected for each of the frequency bands of operation by controlling the differential magnitude, and the differential phase, of the signal or signals, that are applied to the driven elements in each orthogonal plane (horizontal versus vertical, for instance).

Figure 10:
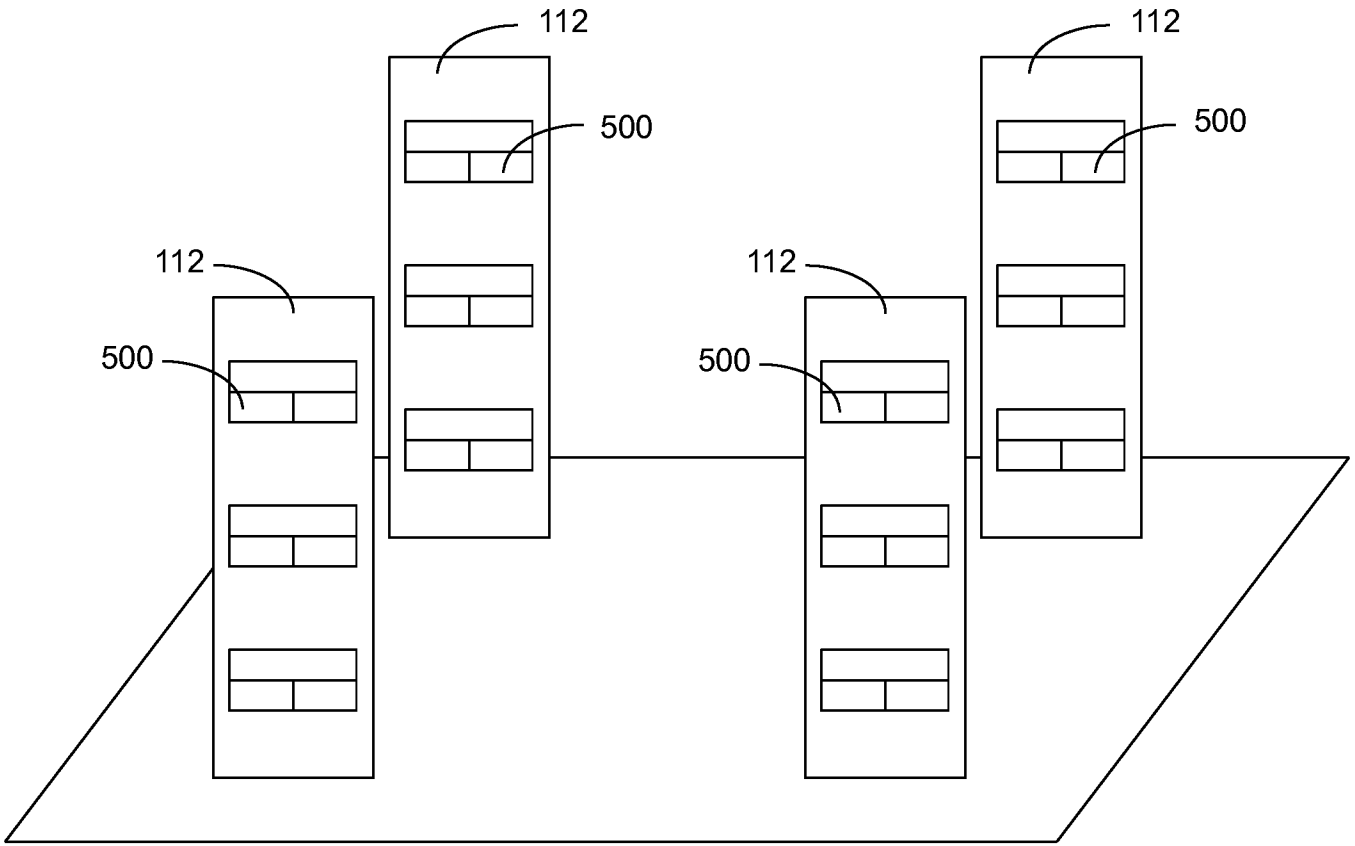
FIG. 10 is a perspective view of a phased array Yagi-like embodiment of the present invention.

In yet another embodiment, the Yagi-like antenna arrangement of FIG. 8 can be replicated such that a plurality of such Yagi-like arrangement are used as elements of a phased array antenna, as shown in FIG. 10, having significant gain or directivity, and can be electronically steered while operating over a considerable bandwidth within multiple frequency bands.

In yet another embodiment, the above cross-polarized Yagi-like antenna arrangement of FIG. 9 can be replicated such that a plurality of such cross-polarized Yagi-like arrangements are used as elements of a phased array antenna, having significant gain or directivity, and can be electronically steered in direction as well as polarization characteristics while operating over a considerable bandwidth within multiple frequency bands.

Figure 11:
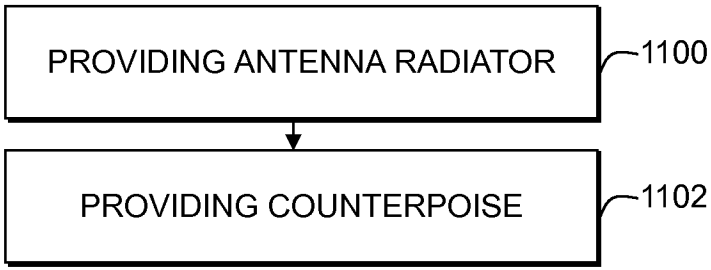
FIG. 11 is a flowchart of a method, in accordance with the present invention.

FIG. 11 illustrates a flowchart of a method for a distributed comb tapped multiband antenna structure. The method includes a step 1100 of providing a PIFA-like antenna radiator having tap structures.

A next step 1102 includes providing a counterpoise to the antenna radiator, wherein the tap structures include shunt connections to the counterpoise.

Advantageously, the inventive technique described herein provides an antenna structure that is contained internally within a single device housing, and that operates over multiple frequency bands. The antenna provides high performance over a considerable bandwidth within each of the multiple frequency bands of operation, even where the frequency bands are not harmonically related.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A distributed comb tapped multiband antenna structure comprising:

a PIFA-like antenna radiator having tap structures;

a counterpoise to the antenna radiator, wherein the tap structures include shunt connections to the counterpoise; and a second antenna radiator that is collinear and opposing the antenna radiator while sharing the counterpoise in common with the antenna radiator, such that the antenna structure is configured as a balanced dipole.

2. The antenna structure of claim 1, wherein at least one shunt connection includes a shunt reactance between the tap and the counterpoise.

3. The antenna structure of claim 2, wherein the shunt reactance includes at least one variable tuning component.

4. The antenna structure of claim 1, further comprising one feed point to drive the antenna radiator.

5. The antenna structure of claim 1, further comprising a plurality of feed points, each driving a tap structure.

6. The antenna structure of claim 1, wherein operating frequency bands of the antenna structure are not harmonically related.

7. The antenna structure of claim 1, wherein the tap structures provide an inter-tap inductive reactance along the antenna radiator between adjacent taps.

8. The antenna structure of claim 1, wherein the counterpoise includes a mechanical modification affecting the reactance of the tap structures.

9. The antenna structure of claim 1, further comprising multiple balanced dipole antenna structures configured in a phased array antenna sharing the counterpoise that constitutes a ground plane of the phased array antenna.

10. The antenna structure of claim 1, wherein the common counterpoise is curved such that the multiple collinear balanced dipole antenna structures provide a quasi-omnidirectional radiating pattern, and wherein the multiple balanced dipole antenna structures operate within multiple frequency bands that are not harmonically related.

11. The antenna structure of claim 1, further comprising multiple balanced dipole antenna structures configured in a Yagi-like antenna array.

12. The antenna structure of claim 11, wherein some of the balanced dipole antenna structures are parasitic antennas.

13. The antenna structure of claim 11, wherein the Yagi-like antenna array is configured as elements of a phased array antenna.

14. The antenna structure of claim 11, wherein the balanced dipole antenna structures are arranged orthogonally in horizontal and vertical polarization planes.

15. The antenna structure of claim 14, wherein the balanced dipole antenna structures are operational with polarization states selected for each frequency band of operation that are applied to structures in each orthogonal plane.

16. A method for a distributed comb tapped multiband antenna structure, the method comprising the steps of:

providing a PIFA-like antenna radiator having tap structures;

providing a counterpoise to the antenna radiator, wherein the tap structures include shunt connections to the counterpoise; and providing a second antenna radiator that is collinear and opposing the antenna radiator while sharing the counterpoise in common with the antenna radiator, such that the antenna structure is configured as a balanced dipole.

17. A communication device having a distributed comb tapped multiband antenna structure comprising:

a PIFA-like antenna radiator having tap structures;

a counterpoise to the antenna radiator, wherein the tap structures include shunt connections to the counterpoise; and a second antenna radiator that is collinear and opposing the antenna radiator while sharing the counterpoise in common with the antenna radiator, such that the antenna structure is configured as a balanced dipole.

* * * * *